United States Patent [19]

Schweinfurter

[11] Patent Number: 4,678,395

[45] Date of Patent: Jul. 7, 1987

[54] REGENERATIVE PUMP WITH FORCE EQUALIZATION

[76] Inventor: Friedrich Schweinfurter, Bergstrasse 6, 8541 Röttenbach, Fed. Rep. of Germany

[21] Appl. No.: 758,138

[22] Filed: Jul. 23, 1985

[30] Foreign Application Priority Data

Jul. 23, 1984 [DE] Fed. Rep. of Germany ..... 3427112

[51] Int. Cl.[4] ..... F04D 5/00

[52] U.S. Cl. ..... 415/53 T; 415/198.2; 415/213 T; 415/106

[58] Field of Search ..... 415/213 T, 53 T, 56, 415/59, 98, 99, 103, 102, 101, 104, 106, 198.2

[56] References Cited

U.S. PATENT DOCUMENTS

| | | | |
|---|---|---|---|
| 1,635,786 | 7/1927 | Holmes | 415/198.2 X |
| 1,979,621 | 11/1934 | Hollander | 415/213 T |
| 3,788,766 | 1/1974 | Engels | 415/213 T |
| 3,917,431 | 11/1975 | Rose | 415/213 T |
| 4,408,952 | 10/1983 | Schweinfurter | 415/53 T |
| 4,556,363 | 12/1985 | Watanabe et al. | 415/53 T |
| 4,566,866 | 1/1986 | Kemmner | 415/198.2 X |

FOREIGN PATENT DOCUMENTS

| | | | |
|---|---|---|---|
| 143920 | 3/1949 | Australia | 415/53 T |
| 156127 | 1/1939 | Austria | 415/53 T |
| 731085 | 2/1943 | Fed. Rep. of Germany | 415/213 T |
| 2105121 | 8/1972 | Fed. Rep. of Germany . | |
| 2112762 | 10/1972 | Fed. Rep. of Germany | 415/213 T |
| 3128374 | 7/1981 | Fed. Rep. of Germany . | |
| 119990 | 7/1983 | Japan | 415/198.2 |
| 119991 | 7/1983 | Japan | 415/198.2 |

*Primary Examiner*—Everette A. Powell, Jr.

*Attorney, Agent, or Firm*—Birch, Stewart, Kolasch & Birch

[57] ABSTRACT

The present invention relates to a regenerative pump having a casing with a casing inlet and casing outlet, an impeller disposed on a shaft and containing at least one bucket ring with axially and radially open bucket compartments on the first and second side of the impeller, and mutually separated side channels having an entrance port, an exit port and an interrupter. The arrangement herein is such that the conveying streams on the two sides of the impeller are separated from each other. The entrance ports of the side channels on the two impeller sides are in communication with the casing inlet, and the exit ports are in communication with the casing outlet, so that the conveying streams are first subdivided and then recombined. The entrance port, the exit port, and the interrupter in opposition to the first impeller side are arranged to be offset in the direction of rotation of the impeller by such an angular amount with respect to the corresponding elements on the second impeller side that the radial forces on the first impeller side, resulting from the pressure differences in the conveying streams between the inlets and the outlets, are counterbalanced by radial forces on the second impeller side that are the same with respect to amount but are effective in the opposite direction. In this way, compensation of the radial forces acting on the pump shaft is attained.

7 Claims, 10 Drawing Figures

REGENERATIVE PUMP WITH FORCE EQUALIZATION

BACKGROUND AND SUMMARY OF THE INVENTION

The present invention relates to a regenerative pump with a casing having a casing inlet and a casing outlet, wherein the radial forces generally acting on the impeller shaft in regenerative pumps are compensated so that the pump is suited for the generation of high, maximum pressures.

For attaining high pressures in case of relatively small conveying streams, multistage regenerative pumps are, as is known, particularly well suitable. Multistage regenerative pumps can be made of an especially simple structure by using only one impeller with an arrangement of several, different-diameter bucket rings with relatively short blades respectively on both sides of the impeller. Customarily, the buckets arranged on the outer periphery are separated from one another by a central web in the axial direction and operate in a side channel common to all of them. Since the pressure in the conveying medium increases steadily from the inlet of the side channel to its outlet, in the direction of travel, a resultant force component in the radial direction is produced by the pressure acting on the impeller. This radial force assumes considerable dimensions at high conveying pressures. In high-pressure pumps of this type, it is consequently necessary to provide reinforced shafts and likewise reinforced bearings. This involves considerable added expense, especially for the shaft seals, and also leads to an undesirably large diameter of the first conveying ring on the inside of the impeller.

DOS No. 2,105,121 discloses a regenerative pump wherein pressure pockets are arranged in the casing for compensating for these radial forces, the pressure pockets being in communication, through conduits, with the intake and delivery sides of the pump. The pressure pockets and the connecting conduits are arranged herein in such a way that the pressure ambient in the pressure pockets acts on a special part of the impeller provided for this purpose, so that the forces acting radially inwardly on the impeller by the pumping process are compensated. However, this solution requires additional control elements in the connecting conduits to obtain a corresponding adaptation of the pressure conditions built up in the pressure pockets to the respective conveying level and/or conveying pressure of the pump. Moreover, this arrangement must tolerate short-circuiting of the pump, leading to a flow of conveying medium from the delivery side via the throttling slots of the pressure pockets to the intake side, resulting in leakage losses. These losses considerably reduce the hydraulic degree of efficiency of the pump, particularly in case of small volume streams.

DOS No. 3,128,374 describes a regenerative pump, the impeller of which exhibits on both sides respectively one bucket ring with closed buckets, mutually separated side channels being arranged in opposition to these bucket rings, each of these side channels exhibiting an entrance port and exit port, as well as an interrupter. The conveying medium flows in this pump in two mutually separated conveying streams via the side channels from the respective side channel entrance to the respective side channel exit. However, the radial forces mentioned above also occur in this pump.

Starting with the above-discussed state of the art, it is an object of the present invention to provide an improved regenerative pump so that the shaft of the impeller essentially needs to transmit and/or absorb only torques.

This object is achieved by providing that the entrance ports are connected with the casing inlet and the exit ports are connected with the casing outlet for the subdivision and subsequent recombination of the conveying streams. Also the entrance port, the exit port, and the interrupter are arranged with respect to the first impeller side in the direction of rotation of the impeller to be offset by such an angular amount with regard to the corresponding elements on the second side of the impeller that the radial forces on the first impeller side, resulting from the pressure differences in the conveying streams between the inlets and the outlets, are opposed by radial forces on the second impeller side that are equal in amount, but act in the opposite direction.

By this procedure, which can be structurally realized very easily, the radial forces that perforce occur are already compensated for in the impeller so that there are no longer any radial forces effective on the shaft of the impeller. It is thereby possible, on the one hand, to make the shaft bearing, with the associated seal, economically of a smaller size, without reducing the lifetime of the pump. moreover, due to the smaller dimensioning of the impeller shaft, an internal blade ring can be provided which has a small diameter and a correspondingly low peripheral speed during operation. Due to the fact that the peripheral speed is low, the acceleration impact on the conveying medium while entering the pump, which lowers the degree of efficiency, is reduced.

It is furthermore possible by the arrangement of the present invention to mount a plurality of blade rings of varying diameters with corresponding side channels, i.e. a plurality of series-connected pumping elements, on a single impeller. This has not been possible on account of the heretofore occurring radial forces and has been circumvented by distributing the pressure stages over several, respectively separately supported impellers.

The solution of the present invention provides a still further advantage in multistage impellers by the feature that the individual blade rings can be respectively constructed with axially and radially open bucket compartments wherein sealing between the conveying stages is effected by radial sealing gaps so that the bucket rings can be staggered in the theoretical minimum spacings. By such minimum spacing, in turn, the above-mentioned acceleration impact on the conveying medium when passing from one stage into the subsequent stage, with its deleterious effects, is diminished. This feature also could not be exploited heretofore since this mode of construction results in very broad impellers leading to undesirably large bearing spacings.

Therefore, in the present regenerative pump, the two impeller and side channel sides, sealingly separated from each other, act inversely, i.e. the respective pressure buildup along the side channel periphery of one side takes place offset by 180° about the shaft axis, i.e. in opposition to the other side channel side. Accordingly, equal-size radial forces oppose each other at any point of the side channel periphery so that the radial forces produced on both sides of the impeller are automatically equalized essentially without losses and without auxiliary devices, in every operating point of the pump.

Due to the structure of the pump, which is free of radial forces, the otherwise occurring vibrations of the shaft due to its bending are likewise avoided so that the lifetime of the pump is thereby further increased.

The tilting moment produced by the axial forces opposed on the two impeller sides extends in opposition to the tilting moment acting on the two impeller sides by the radial forces. Thus, with a corresponding dimensioning of the depth of the impeller, a compensation of moments and accordingly an essentially force-free shaft (except for the torques) can be attained.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
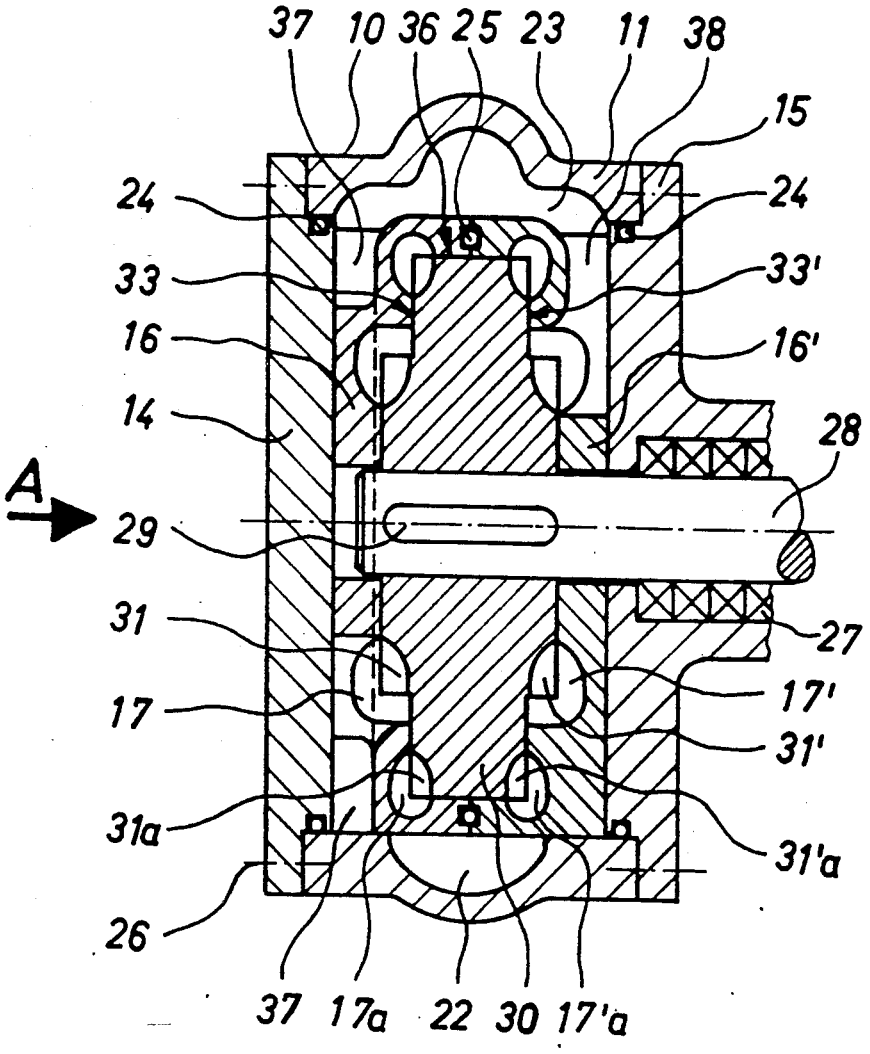
FIG. 1 is a longitudinal sectional view of a preferred embodiment of the regenerative pump according to the present invention taken along line I—I of FIG. 2.

The preferred embodiment of the pump illustrated in FIGS. 1–8 depicts a two-stage, dual-flow regenerative pump with a radial output stage sealing gap 36 and consists of a casing 10 and an impeller 30. The casing 10 is made of multiple parts and comprises a casing collar 11 with casing entrance port 12 and exit port 13 (FIG. 2), a casing lid 14 on the end face, a bearing cover 15 on the driving side, and the two side channel members 16 and 16'.

The side channel members 16 and 16' contain the side channels 17 and 17' with side channel entrance ports 18 and 18', side channel exit ports 19 and 19', crossover channels 21 and 21', as well as the side channel interrupters 20 and 20'.

Figure 2:
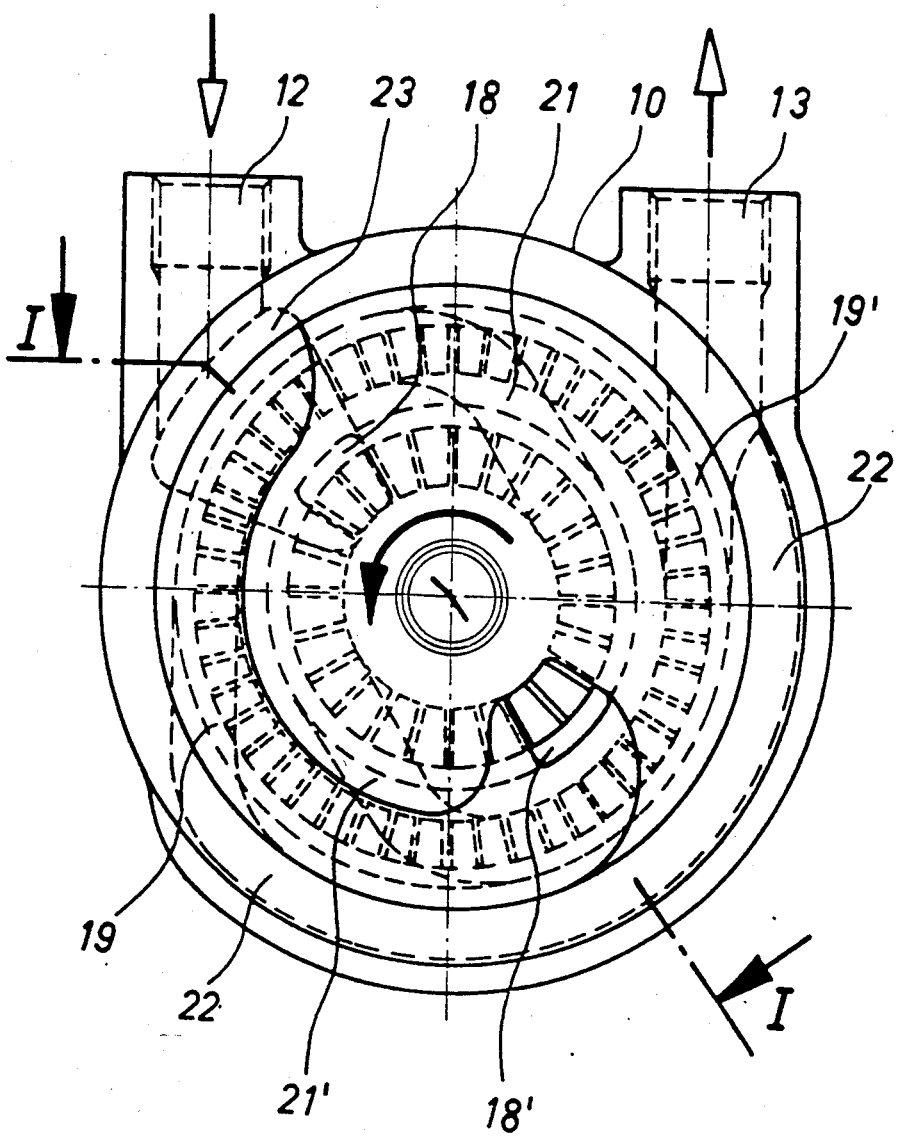
FIG. 2 is a view of the direction of arrow (A) of the regenerative pump according to FIG. 1 with the casing lid on the end face having been removed.
Figure 3:
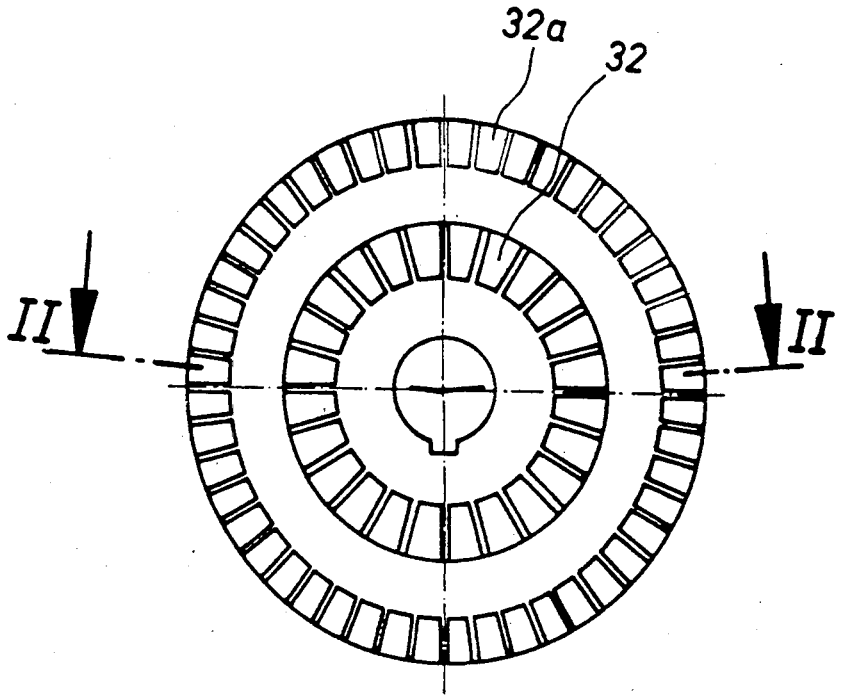
FIG. 3 is an elevational view of the impeller of FIGS. 1 and 2.
Figure 4:
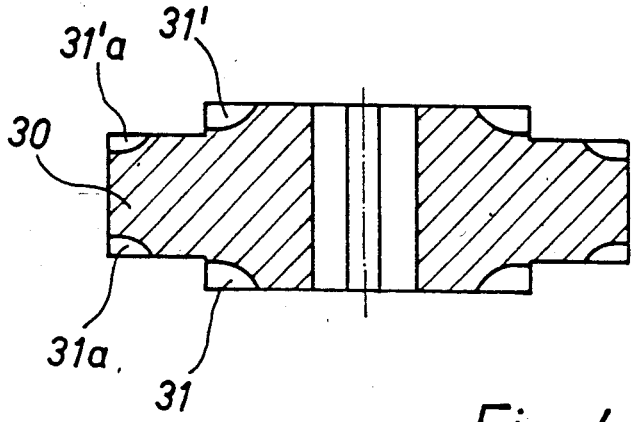
FIG. 4 is a section taken along line II—II of FIG. 3.
Figure 5:
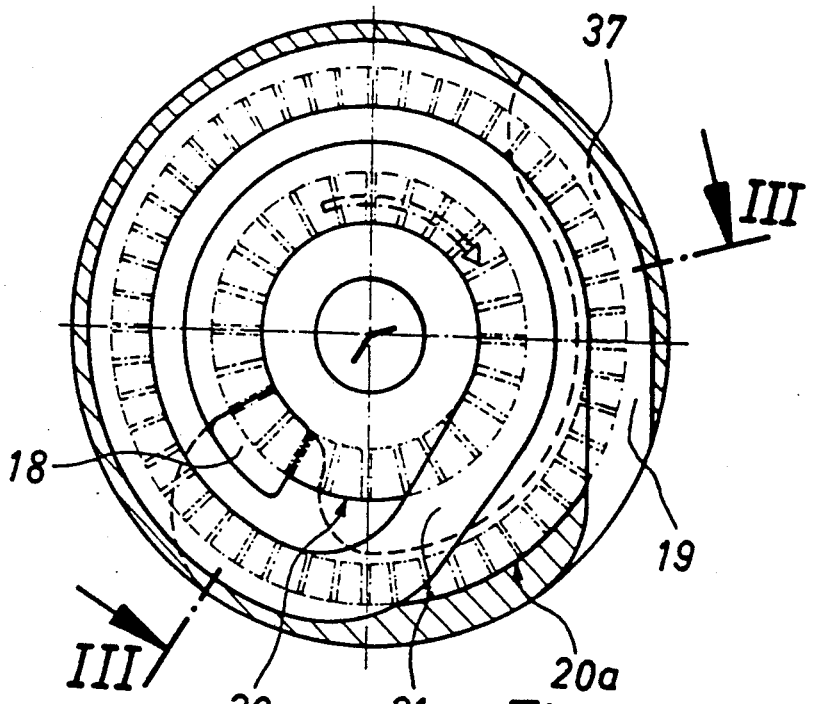
FIG. 5 is a section taken along line IV—IV of FIG. 6 showing the first side channel member from FIG. 1 with the impeller in dot-dash lines.
Figure 6:
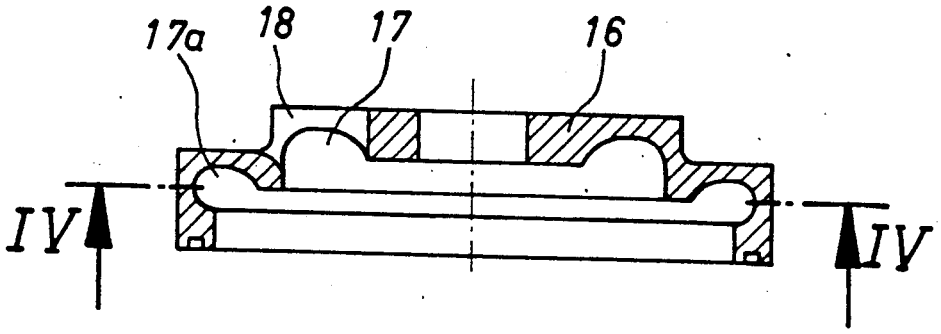
FIG. 6 is a section taken along line III—III of FIG. 5.
Figure 7:
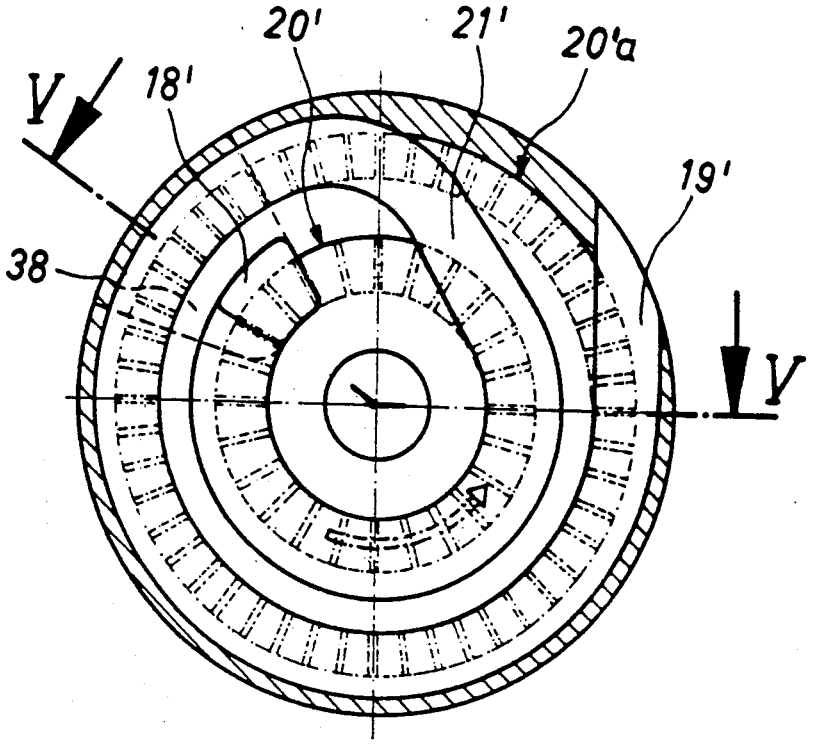
FIG. 7 is a section taken along line VI—VI of FIG. 8 showing the second side channel member from FIG. 1 with the impeller in dot-dash lines.
Figure 8:
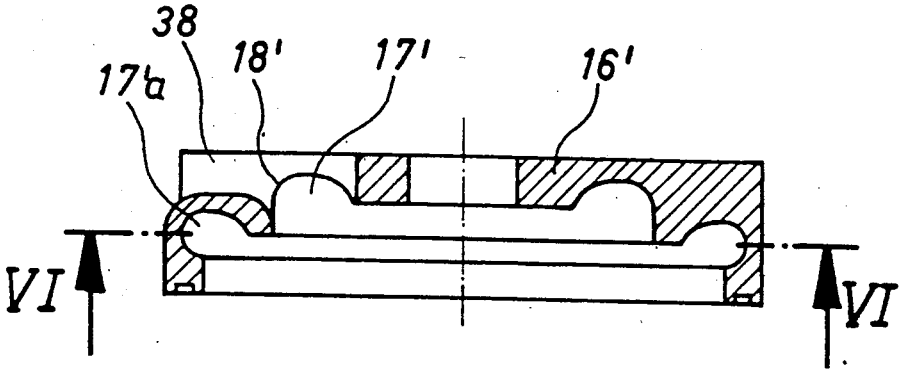
FIG. 8 is a section taken along line V—V of FIG. 7.

The casing lid 14 and the bearing cover 15 are sealed off in the casing collar 11 by 0-seals 24 and threaded to the casing collar 11 by means of casing screws 26 (indicated by center lines). The side channel members 16 and 16' arranged in the casing 10 are sealed off from each other by an 0-seal 25 and are fixed in the axial direction by the casing lid 14 and the bearing cover 15. A shaft 28, sealed by way of packing rings 27 is supported in the bearing cover 15 of the casing 10 and is set into rotation by a drive motor, not shown, for example an electric motor, in the direction of the arrow (FIG. 2). The impeller 30 is affixed to the free end of the shaft 28 by means of an adjusting spring 29.

The two-stage impeller 30 exhibits on its first side bucket rings 31, **31*a*, on its second side bucket rings 31', 31'*a*, which are formed from radially and axially open buckets 32, 32*a* and 32', 32'*a***, respectively.

The conveying medium entering through the casing entrance port 12 of the casing 10 is divided in a distributor channel 23 worked into the housing 10, into two conveying streams passing separately into the side channel entrance ports 18 and 18' via feed channels 37, 38 in the side channel members 16 and 16'. In this arrangement, the side channel entrance ports 18 on one side of the impeller are arranged offset by 180° about the shaft axis with respect to the side channel entrance ports 18' on the other side of the impeller. The conveying medium entering the side channels 17, 17' of the first stage passes into the buckets 32, 32' of the bucket rings 31, 31' of the rotating impeller 30. In the bucket compartments 32 and 32', displacement currents are formed by centrifugal force, these currents flowing respectively in a helically wound flow path over the entire length of the side channels and alternatingly reentering the bucket compartments 32 and 32' of the impeller 30. By this constant reentering, energy is transferred to the conveying stream flowing more slowly in the side channel and being on a lower energy level (pressure, velocity), by impulse exchange from the more rapidly rotating liquid volume of a higher energy level of the bucket compartments 32, 32' of the impeller 30.

At the end of the side channels 17, 17', the conveying medium enters, via crossover channels 21, 21', the side channels **17*a* and 17'*a* of the second stage where, by way of the buckets 32*a* and 32'*a* of the bucket rings 31*a* and 31'*a* of the impeller 30, a further impulse exchange takes place, as described above for the first stage. After this additional supply of energy, the conveying medium passes via the side channel exits 19 and 19' in the side channel members 16 and 16' into a feed channel 22 in the casing 10 and from there out of the casing through the outlet orifice 13**.

The pressure buildup in the side channels 17 and **17*a* of the side channel member 16 takes place inversely on account of the angular displacement (180°) with respect to the side channel member 16' with side channels 17' and 17'*a*. This means that the force acting in the radial direction on the shaft at each point of the periphery of the side channels 17 and 17*a* of the side channel member 16 is counteracted by a counterforce of equal size in its amount from each point of the periphery of the side channels 17' and 17'*a* of the side channel member 16'*a***.

The two bucket rings **31*a* and 31'*a* on the outside of the impeller are separated from each other by a relatively broad web which forms a cylindrical outer surface of the impeller. The two side channel members 16, 16' together form a "web" of the same width between the two outer side channels 17*a*, 17'*a*, so that the two conveying streams of the output stages are sealed off from each other via a radial output stage sealing gap 36. Sealing between the stages on the respective impeller sides takes place in this embodiment by axial intermediate-stage sealing gaps 33, 33'**.

With a correspondingly skillful choice or calculation of the radial and axial dimensions of the vane rings, the result is not only compensation of the radial forces acting on the shaft but also of the torques about the center of the impeller caused by the shaft, making the impeller tilt on the shaft, since the forces acting on the impeller in the axial direction produce a moment that is opposed to the first-mentioned torque.

Figure 9:
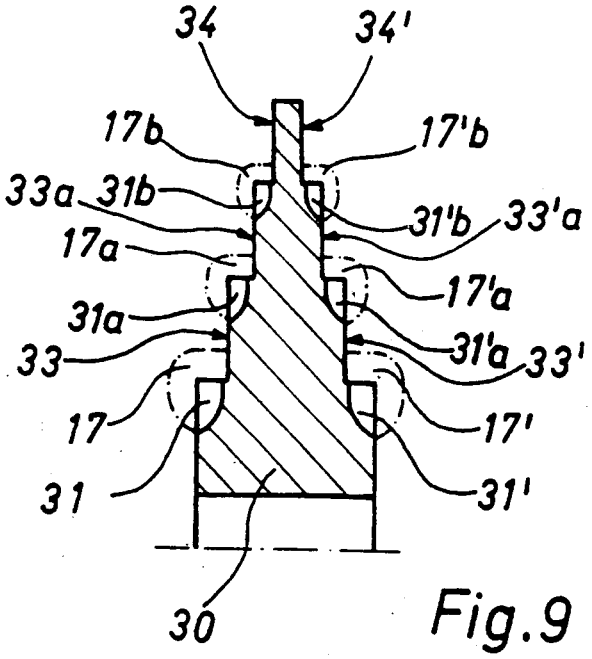
FIG. 9 is a half-sectional view of another preferred embodiment of an impeller with bucket rings and with side channels indicated in dot-dash lines, and with axial output stage sealing gaps for separating the conveying streams and with axial intermediate-stage gaps.
Figure 10:
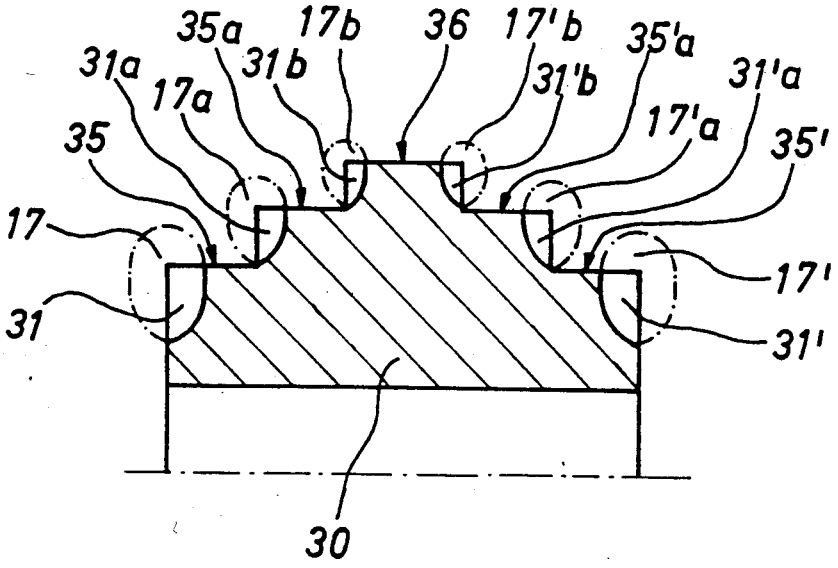
FIG. 10 is a half-sectional view of a further preferred embodiment of an impeller with bucket rings having side channels indicated in dot-dash lines and with radial output stage sealing gaps on the outer periphery and radial intermediate-stage sealing gaps.

FIGS. 9 and 10 show merely half-sectional views of impellers of further preferred embodiments wherein the associated side channel members with side channels, crossover channels, sealing gaps, etc. are fashioned in correspondence with the above-described embodiment unless indicated otherwise.

In the embodiment of FIG. 9, bucket rings 31, 31*a*, 31*b* are arranged on one side of the impeller, and bucket rings 31', 31'*a* and 31'*b* are arranged on the other side, opposed by side channels (indicated in dot-dash lines) 17, 17*a*, 17*b* and 17', 17'*a*, 17'*b*, respectively. The separating seal between the output stages 17*b*, 17'*b* on the two impeller sides is provided by way of axial output stage sealing gaps 33 and 33' arranged between the impeller 30 and the side channel members 16, 16'.

In a further preferred embodiment of the regenerative pump illustrated in FIG. 10, sealing of the conveying streams takes place, from stage to stage as well as of the two output stages with respect to each other, by way of radial sealing gaps 35, 35*a*, 35', 35'*a* and 36. In this impeller, the diameters of the bucket compartment rings increase only by the minimally possible amount since sealing from one stage to the next takes place substantially exclusively by radial gaps. Due to the fact that the peripheral speed of the bucket rings rises from stage to stage merely by a small amount, only a minor acceleration impact, lessening the degree of efficiency of the pump, occurs upon entrance of the conveying medium into the respectively subsequent side channel. It is possible in this way to connect in series a relatively large number of stages in a regenerative pump having a single impeller, so that high pressures can be attained in spite of the low structural expenditure (few parts, low assembly costs). Impellers of such a width, resulting from such a construction, have not been utilizable heretofore inasmuch as the impeller width necessitated an undesirably large distance between the two shaft bearings.

What is claimed is:

1. a regenerative pump comprising a casing having a casing inlet and a casing outlet, an impeller provided on a shaft and rotatably disposed within said casing, at least one blade ring with radially and axially open blade compartments disposed on a first side and on a second side of said impeller, side channels disposed within said casing and separated from one another by sealing gaps, each of said side channels being provided with an entrance port, an exit port, and an interrupter means, wherein said side channels are arranged with respect to the blade rings so that a conveying medium flows, in two substantially mutually separated conveying streams, through said side channels from a respective side channel entrance to a respective side channel exit, under increasing pressure, characterized in that said entrance ports are connected with said casing inlet, and said exit ports are connected with said casing outlet for subdividing and recombining said conveying streams, wherein said entrance ports, said exit ports, and said interrupters are arranged with respect to said first impeller side in the direction of rotation of said impeller, offset by an angular amount ($\alpha$) with regard to their corresponding elements on said second impeller side so that the radial forces on said first impeller side, resulting from the pressure differences in said conveying streams between the inlets and outlets, are opposed by equal-size but oppositely directed radial forces on said second impeller side.

2. The regenerative pump according to claim 1, wherein an axial output-stage sealing gap for providing the sealing separation of the two conveying streams is arranged on the outer periphery of said impeller.

3. The regenerative pump according to claim 1, wherein on at least one impeller side, at least two bucket rings with differing diameters are provided, the respective side channels of which being connected in series.

4. The regenerative pump according to claim 3, wherein radial sealing gaps in the intermediate stages are arranged for sealing purposes between the different-diameter bucket rings of the impeller and said side channels which are worked into side channel members.

5. The regenerative pump according to claim 4, wherein axial sealing gaps in the intermediate stages are arranged for sealing purposes between the different-diameter bucket rings of the impeller and said side channels which are worked into side channel members.

6. The regenerative pump according to claim 3, wherein the bucket rings and the associated side channels are dimensioned, with respect to the effective areas of the conveying stream pressure on the impeller, so that the torques about the impeller center resulting from the axial forces and from the radial forces counterbalance each other.

7. The regenerative pump according to claim 1, wherein said two impeller sides and associated side channels are of essentially identical configuration, and the angular amount ($\alpha$) of the offsetting is 180°.

* * * * *